US007353681B2

(12) United States Patent
Ball et al.

(10) Patent No.: US 7,353,681 B2
(45) Date of Patent: Apr. 8, 2008

(54) ROLL EMBOSSING OF DISCRETE FEATURES

(75) Inventors: Melville Douglas Ball, Kingston (CA); John Anthony Hunter, Kingston (CA); Gary J. Smith, Glenburnie (CA)

(73) Assignee: Novelis Inc., Toronto, Ontario (CA)

( * ) Notice: Subject to any disclaimer, the term of this patent is extended or adjusted under 35 U.S.C. 154(b) by 0 days.

(21) Appl. No.: 11/293,424

(22) Filed: Dec. 1, 2005

(65) Prior Publication Data

US 2006/0123867 A1 Jun. 15, 2006

Related U.S. Application Data

(60) Provisional application No. 60/633,333, filed on Dec. 3, 2004.

(51) Int. Cl.

| | |
|---|---|
| ***B21H 8/02*** | (2006.01) |
| ***B44C 1/24*** | (2006.01) |
| ***B44B 5/00*** | (2006.01) |
| ***B21B 1/28*** | (2006.01) |
| ***B21B 27/02*** | (2006.01) |

(52) U.S. Cl. ..... 72/197; 72/252.5; 72/190; 72/475; 492/30

(58) Field of Classification Search ..... 72/197, 72/385, 379.6, 188, 196, 252.5, 379.2, 105, 72/106, 470, 471, 472, 473, 474, 475, 191; 492/30–37

See application file for complete search history.

(56) References Cited

U.S. PATENT DOCUMENTS

| | | | | |
|---|---|---|---|---|
| 737,291 | A * | 8/1903 | Smyth | 72/71 |
| 1,050,879 | A * | 1/1913 | Wadsworth | 72/188 |
| 2,639,660 | A * | 5/1953 | Sunderhauf et al. | 101/23 |
| 3,599,465 | A | 8/1971 | Chenevier | 72/207 |
| 3,686,917 | A * | 8/1972 | Hikida et al. | 72/187 |
| 4,503,696 | A * | 3/1985 | Roeder | 72/197 |
| 4,725,111 | A | 2/1988 | Weitzen et al. | 350/3.85 |
| 4,773,718 | A | 9/1988 | Weitzen et al. | 350/3.61 |

(Continued)

FOREIGN PATENT DOCUMENTS

| | | |
|---|---|---|
| CA | 1320022 | 7/1993 |

(Continued)

*Primary Examiner*—Dmitry Suhol
(74) *Attorney, Agent, or Firm*—Cooper & Dunham LLP

(57) ABSTRACT

A cold rolling process for impressing a pattern on a surface of a sheet metal article involves passing the sheet article through a pair of rolls and engaging a patterning feature with isolated areas of a surface of the sheet article, at a localized pressure to plastically deform at least the surface of the sheet article. A rolling pressure is maintained on other areas of the sheet article that is less than the bulk elastic yield strength of the metal. A cold rolling apparatus is also described having a pair of rolls, each with partially cylindrical outer surfaces. The rolls have a gap between the cylindrical parts. One of the rolls has a localized surface region that is displaced relative to the surface of the roll. When the localized region is brought near the other roll, a spacing exists that is narrower than the gap. One of the rolls has a localized patterning feature that aligns with the localized surface region to impress a pattern into the sheet article. The gap allows the rolls to engage opposite surfaces of the sheet article while imparting compression less than a bulk elastic yield strength of the metal.

6 Claims, 4 Drawing Sheets

U.S. PATENT DOCUMENTS

| | | | | |
|---|---|---|---|---|
| 4,841,611 | A | 6/1989 | Kusaba et al. | 29/121.2 |
| 4,959,275 | A | 9/1990 | Iguchi et al. | 428/603 |
| 4,978,583 | A | 12/1990 | Wakui et al. | 428/600 |
| 5,009,093 | A | 4/1991 | Quinn, Jr. et al. | 72/177 |
| 5,327,825 | A | 7/1994 | Parker et al. | 101/32 |
| 5,789,066 | A | 8/1998 | De Mare et al. | 428/156 |
| 5,799,525 | A * | 9/1998 | Johnson et al. | 72/105 |
| 5,881,444 | A | 3/1999 | Schaefer et al. | 29/527.1 |
| 6,006,415 | A | 12/1999 | Schaefer et al. | 29/527.1 |
| 6,187,455 | B1 * | 2/2001 | Eschauzier | 428/687 |
| 6,604,457 | B2 * | 8/2003 | Klug | 101/32 |
| 7,096,709 | B2 * | 8/2006 | Hutchison et al. | 72/482.94 |
| 2002/0090578 | A1 | 7/2002 | Schaefer et al. | 430/320 |
| 2004/0003638 | A1 | 1/2004 | Schaefer et al. | 72/41 |
| 2004/0112104 | A1 * | 6/2004 | Scamans et al. | 72/187 |

FOREIGN PATENT DOCUMENTS

| | | |
|---|---|---|
| EP | 0 456 162 | 3/1995 |
| EP | 1 146 971 | 8/2002 |
| JP | 09085306 A * | 3/1997 |
| WO | WO 97/31783 | 9/1997 |
| WO | WO 01/11435 | 2/2001 |
| WO | WO 02/072290 | 9/2002 |

* cited by examiner

ROLL EMBOSSING OF DISCRETE FEATURES

CROSS-REFERENCE TO RELATED APPLICATIONS

This application claims the priority right of Applicant's prior Provisional Application Ser. No. 60/633,333 filed Dec. 3, 2004.

FIELD OF THE INVENTION

The present invention relates to methods and devices for the application of textured patterns on sheet metal. More particularly, it relates to a roll embossing process and apparatus to modify the surface topography of the sheet in discrete areas. Such localized modification of topography can be used to pattern or brand the surface, or to impart a desired function to the surface.

BACKGROUND ART

In producing rolled sheet metal products, it is often desirable to apply to a portion of the product a logo or pattern, to identify a particular brand, distinguish the product from other similar products, or to modify certain properties of the surface. The scale of surface modification need only involve microscopic changes in topography, or depth, relative to the sheet metal thickness.

In applying a textured pattern, or any discrete feature, it is highly desirable that the bulk elastic yield strength of the sheet metal not be surpassed. Exceeding the bulk elastic yield strength can cause modifications in the thickness, length or shape of the sheet metal. These modifications can affect the flatness of the sheet, resulting in wrinkling or buckling with consequent problems in handling and quality. However, in order to ensure that the desired patterning feature is distinguishable and clearly imprinted, it is necessary to apply sufficient pressure to modify the surface topography of the sheet material in the area of the desired feature.

Traditional patterning methods have used large uniform loads across the surface of the sheet metal, resulting in plastic deformation throughout the sheet as the pattern or logo is applied. As mentioned above, this results in reduction of the thickness of the strip (i.e. exceeding the through thickness yield strength of the sheet metal). Even very small reductions in metal thickness can cause a loss of flatness in the rolled product. Hence, conventional roll texturing of sheet surfaces is usually confined to rolling operations incorporating sophisticated methods of flatness control for the strip product.

A further problem in accommodating metal reduction as part of a rolling process to convert surface topography is pattern distortion. By definition, if a sheet article is made thinner by the applied forces in the roll bite, the sheet will extend in length, along the rolling direction. This elongation inevitably distorts any patterning features transferred to the strip from an embossing roll.

Prior art methods of applying microscopic patterns, commonly in the form of diffraction gratings or holographic images, invariably require relatively malleable sheet materials (e.g. metalized polymer films). This, in turn, requires that the sheet be heated prior to embossing. Heat is required since, in applying a typical diffraction grating or hologram at low temperature to a metal surface, the following dilemma is faced: a pressure sufficient to reproduce all of the detail can cause distortion of the metal substrate; whereas lower pressure, below the yield strength, can result in clarity and intensity of the pattern being lost.

Attempts have been made in the past to apply distinct patterns or logos to rolled sheet metal. European Patent Publication EP 338 378, herein incorporated by reference, discloses a technique and apparatus for transferring a hologram on a limited area of an end product by the use of raised portions on a roll, which contain the hologram pattern to be applied. PCT patent publication WO 02/072290, herein incorporated by reference, discloses a multi-roll rolling process for producing randomly textured sheet under conditions in which the rolling pressure is always less than the yield strength of the metal substrate.

A number of patent documents, such as Japanese Patent Publications JP 5104102 and JP 9085306, both of which are herein incorporated by reference, disclose forming roll surfaces with projecting and recessed protrusions to roughen sheet metal surfaces, however there is no teaching of achieving distinctive logos on the imprinted sheets.

Other patent documents, such as Japanese Patent Publication JP 59178144, herein incorporated by reference, disclose a method of producing an embossed plate of reduced weight by rolling the plate between two rollers having shoulder parts of recessing and projecting grooves so that the radius of curvature and the overall thickness of the embossed plate differ from the original plate.

Still further documents, such as U.S. Pat. No. 5,552,235, herein incorporated by reference, teach embossing methods in which one of the rolls is textured and the other is flat, but again, there is no teaching of creating clear and distinguishable logos, or of preventing changes in the sheet thickness.

U.S. Pat. No. 5,799,525, herein incorporated by reference, discloses means for embossing a cylindrical side wall of a can body by use of male and female tooling members having protuberances and indentations of various elevations to apply embossed features to the can body.

There is a need therefore for an improved process and apparatus for imprinting sheet metal strip with distinct logos or patterns, which can be used without the need to heat the sheet metal. There is also a need for a simple and effective means of applying microscopic patterns and logos to sheet metal without distorting the characteristics of the sheet metal or of the logos to be imprinted.

SUMMARY OF THE INVENTION

According to one aspect of the present invention, there is provided a cold rolling process for impressing one or more discrete patterns on a surface of a sheet article made of a predetermined metal. The process involves passing the sheet article through a pair of rolls and engaging a patterning feature with isolated areas of the surface of the sheet article upon which the pattern is to be impressed, at a localized pressure to plastically deform at least the surface of the sheet article at the isolated areas. A rolling pressure is maintained on other areas of the sheet article that is less than the bulk elastic yield strength of the metal.

In another aspect of the invention, there is provided a cold rolling apparatus for impressing one or more discrete patterns on isolated areas of a surface of a sheet article made of a predetermined metal. The apparatus comprises a pair of rolls each having an outer surface that has a cylindrical part, said rolls being disposed with a gap present between said cylindrical parts of said rolls. One of the rolls of said pair has a localized surface region that is displaced relative to the cylindrical part of said roll such that, when said localized region is brought into proximity with the other roll of said pair, a spacing exists therebetween that is narrower than said gap. In addition, one of said rolls of said pair has a localized patterning feature to be impressed on a surface of said sheet article, said localized patterning feature being aligned with said localized surface region, at least when engaging said sheet article, for impressing said pattern into a surface of said sheet article at said isolated areas. The gap is of a width effective to cause said cylindrical parts of said rolls to engage opposite surfaces of said sheet article while imparting compression less than a bulk elastic yield strength of said metal.

BRIEF DESCRIPTION OF THE DRAWINGS

Preferred embodiments of the present invention are described below, in conjunction with the accompanying figures, wherein.

DETAILED DESCRIPTION OF PREFERRED EMBODIMENTS

The present invention is based on finding a balance between applying sufficient localized pressure to create a discrete area of modified surface topography while avoiding thinning, elongating, wrinkling and buckling of the sheet article. This is achieved by attending to two factors: 1) confining the patterning features to relatively small areas of the roll surface, and 2) creating areas of reduced roll gap in alignment with the patterning features. This results in sufficient localized pressure to plastically deform a surface of the sheet article, thereby forming discrete features on the sheet article such as patterns, logos, or areas with modified surface properties.

For the purposes of the present invention, a pattern is defined as any shape, band, outline or surface modification that is imprinted on the sheet metal surface forming a discrete logo, decorative design, utilitarian marking, noticeable surface feature, or area with enhanced, desired properties. A pattern can include, for example, company or product logo, holographic images, diffraction gratings, discrete designs or bar codes. The patterns of the present invention are described as localized or discrete. This means that the patterns are sufficiently spaced apart from each other that each pattern has distinguishable borders that do not flow into the borders of adjacent localized patterns. In addition, the patterning features are sufficiently spaced to maintain a desired degree of pressure intensification across the patterning features in contact with the sheet article and prevent load sharing between adjacent patterning features. In this way, each discrete patterning feature is applied with a distinct, localized pressure as the sheet metal passes through the roll bite. For illustrative purposes only, patterning features that are, for example 1 cm (0.39") in diameter can be spaced approximately 2 cm (0.79") apart across the roll bite and have been found to produce distinctive localized patterns.

The localized pressure, caused by the areas of reduced roll gap corresponding to the patterning features, is sufficient to plastically deform at least a surface of the sheet article in the discrete area of the patterning feature. However, depending on the pattern being applied, the localized pressure may or may not also exceed the through thickness yield strength of the sheet article in the discrete patterning area. For the purposes of the present invention, the through thickness yield strength is defined as the strength at which plastic deformation occurs through the entire thickness (or gauge) of the sheet article, as opposed to deformation only at the surface of the sheet article. When the localized pressure does not exceed the through thickness yield strength, only the surface of the sheet article is plastically deformed. When the localized pressure exceeds the through thickness yield strength, plastic deformation occurs on the surface and into the thickness of the sheet article.

Figure 1:
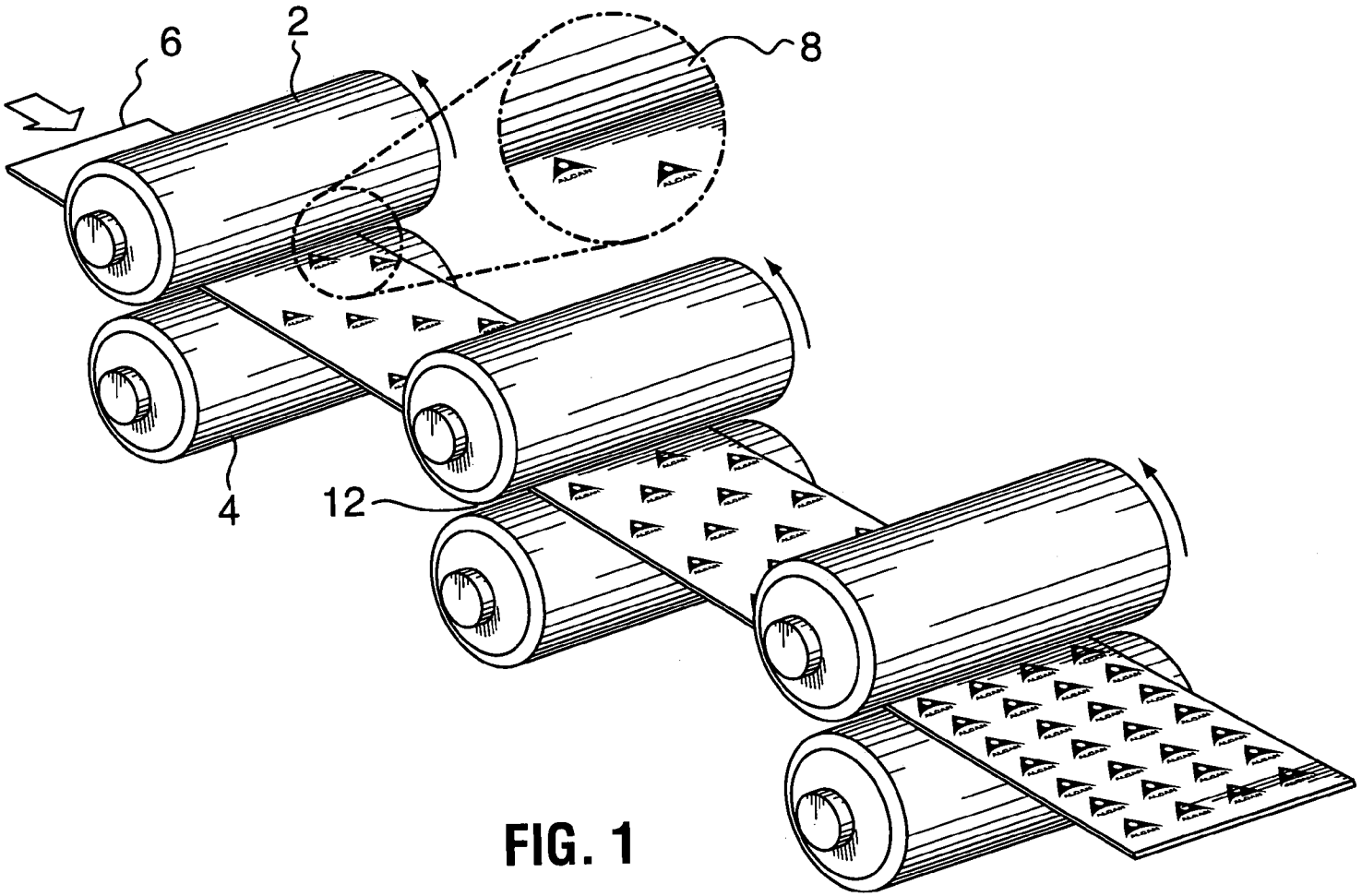
FIG. 1 is a perspective view generally showing one form of apparatus according to the present invention.

The pair of rolls of the present invention is preferably used in a one-pass process, meaning that the images are not necessarily built up by successive passes through a multi-roll stand. In this way there is no need to exactly align the sheet article for multiple passes. However, multi-roll stands can be used to transfer additional images onto empty spaces remaining after a previous transfer, or to re-apply the same image to the same area to intensify the patterning. This is illustrated in FIG. 1. The overall applied load at each stand would be low, and therefore capital costs can also be kept low.

The process of the present invention is conducted as a cold rolling (ambient temperature) process, meaning that it is not necessary to heat the sheet article before it is passed through a roll stand.

Although, as noted earlier, FIG. 1 of the accompanying drawings shows multiple roll stands aligned in sequence, individual patterning features can be generated in one pass at each stand. Hence, depending upon the number of patterning features required, a commercial process could involve just one stand. With reference to FIG. 1, each roll stand consists of a pair of rolls, including a work roll 2 and a counter roll 4, acting on a strip of sheet article 6 passing between the pair of rolls. A roll gap 12 is provided between the rolls of each pair to receive the sheet article 6. A number of preferred embodiments are now described for applying discrete features to the sheet article, with reference to the figures.

Figure 2:
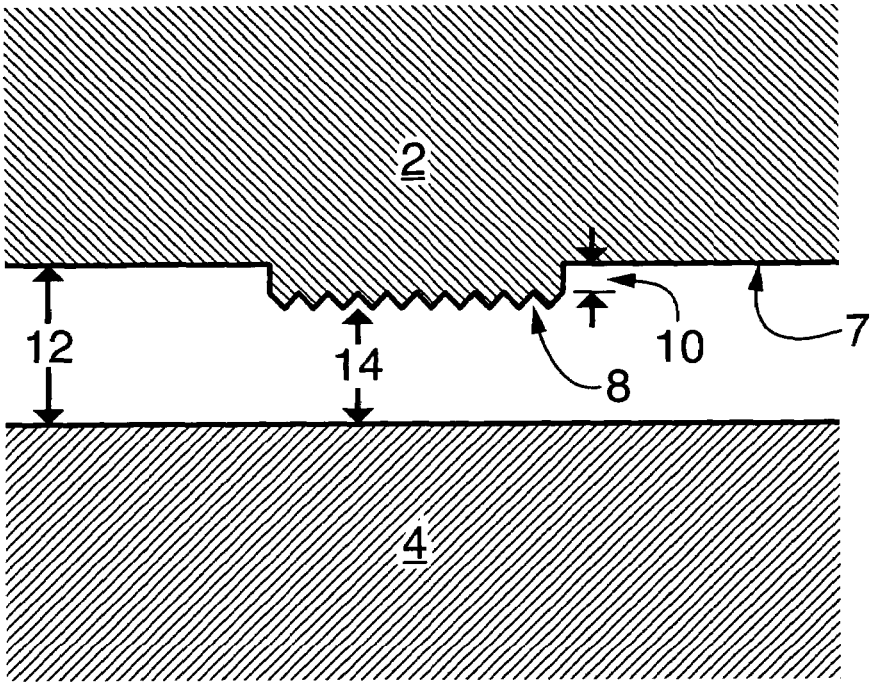
FIG. 2 is a detailed cross section of FIG. 1, showing a first embodiment of the present invention.

A first embodiment of the present invention is shown in FIG. 2. In this embodiment, a surface of the work roll 2 is selectively back polished in regions 7 between localized patterning features 8 of interest (only one patterning feature 8 is shown in FIG. 2, but several such features could be incorporated on the surface of a single work roll). In this way, the patterning features 8 are left displaced from the remaining cylindrical part of the work roll 2, creating a localized surface region in the form of a plateau feature 10. Material from the surface of the work roll 2 can alternatively be removed by any other well know means such as, for example abrasion, grinding, etching or plasma or spark erosion of the roll surface in between the features of interest.

As the plateau feature 10 enters the roll-bite, its height relative to the remaining surface of the work roll 2 reduces the roll-gap 12 between the work roll 2 and the counter roll 4. The space 14 created by the reduced roll-gap 12 has the effect of increasing local contact pressure between the patterning features 8 on the work roll 2 and a surface of the sheet article 6 (not shown in FIG. 2) as it passes through the roll bite. The localized pressure intensification causes plastic deformation of the surface of the sheet article 6 to thereby transfer the pattern. The patterning feature 8 formed on the plateau feature 10 has a distinctive surface topography but has negligible height relative to a surface of the plateau feature 10.

The local increase in pressure across the area of the pattering feature results in improved pattern transfer across the plateau feature 10. In this way, sufficient contact pressures can be applied locally to allow the transfer of very fine scale topographic features, for example diffraction gratings.

It is found that the plateau feature 10 need only be a few microns higher than the remaining cylindrical part of the work roll 2 to achieve a desired level of pressure intensification and improved pattern transfer. The optimal height of the plateau feature 10 is dependant upon several factors including the metal temper, the initial topography of a receiving surface of the sheet and the type of topography being imprinted from the work roll. In some cases, depending on the nature of pattern to be imprinted, strip metals having a higher hardness or temper, or a rougher surface may require higher plateau features 10 than softer or smoother metal strips. As well, when imprinting very fine scale topographies such as, for example diffraction gratings, the plateau features 10 may be of less height than when imprinting other features. Preferably, the plateau feature 10 is at least 5 microns ($3.9\times10^{-5}$ inches) higher than the remaining surface of back polished regions 7 of the work roll 2.

Figure 3:
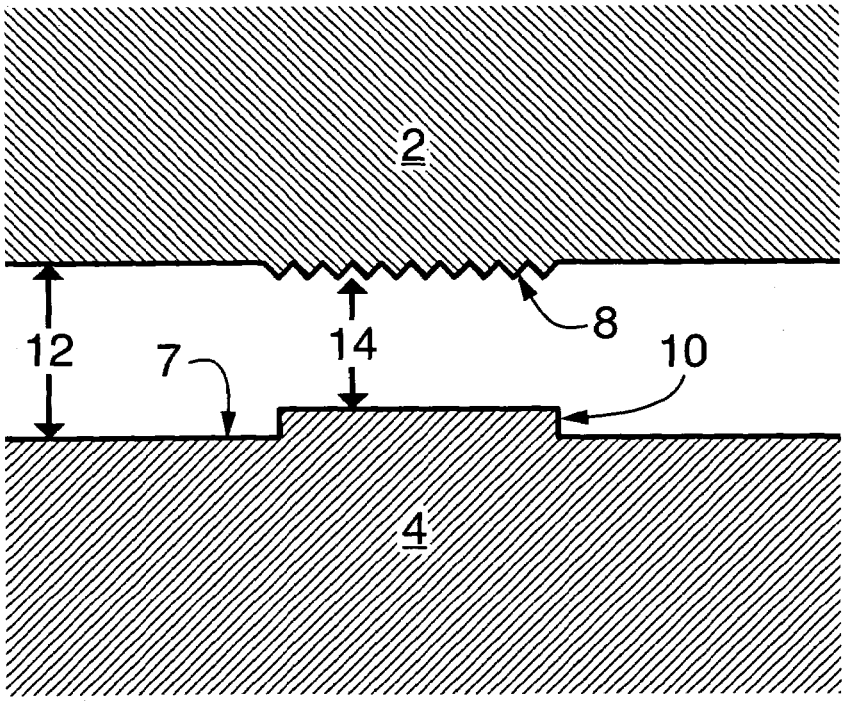
FIG. 3 is another detailed cross section of FIG. 1, showing a second embodiment of the present invention.

A second embodiment of the present invention is illustrated in FIG. 3, in which the raised plateau features 10 are formed on the counter roll 4, rather than on the work roll 2. As in the first embodiment, the plateau features 10 can be formed by selective back polishing, grinding or other means known in the art. In this embodiment, placement of each of the plateau features 10 is arranged to align with each of the patterning features 8 as the rolls rotate. For this reason, rotation of the counter roll 4 is synchronized to ensure that each of the raised plateau features 10 enters the roll-bite in alignment with one of the patterning features 8 on the work roll 2. As illustrated by FIG. 3, the patterning features 8 on the work roll 2 have a different surface topography but generally the same height as the remaining cylindrical parts of the work roll 2. The plateau features 10 are a few microns higher than the remaining cylindrical parts of the surface of the counter roll 4, thus creating the reduced space 14. Similar to the first embodiment, and as discussed above, the height of the plateau feature depends on a number of factors, including properties like the gauge (thickness) of the strip material being imprinted and the nature of pattern to be imprinted. In some cases, thicker gauge strip material may require higher plateau features 10 than thinner gauge strips.

Preferably, the plateau feature 10 is at least 5 microns higher than the remaining surface of the counter roll 4. As in the previous embodiment, the space 14 acts to increase the local contact pressure between the patterning feature 8 and the sheet article 6 to thereby cause plastic deformation of the surface of the sheet article as the pattern is applied.

The second embodiment is particularly useful for thinner gauge materials since forming the plateau features 10 on the counter roll 4 serves to improve edge definition of the pattern to be imprinted. The second embodiment also acts to reduce rates of wear of the patterning features 8 in the roll bite. Since the plateau features 10 are patternless, micro-scale wear on the plateau features 10 has no effect on the sharpness of the patterning features. By contrast, if the patterning features 8 are formed on the raised plateau features 10, there is a slightly higher chance that micron scale wear will reduce transfer efficiency of any fine patterning. As well, there is often a tendency for metal to flow outwards towards the edges of the plateau features 10 during plastic deformation, thereby creating shear forces concentrated around the edges of the plateau feature 10. If the patterning feature 8 is formed on the plateau feature 10, there is a chance that these shear forces may erode away any patterning near the edges of the plateau feature 10.

Figure 4:
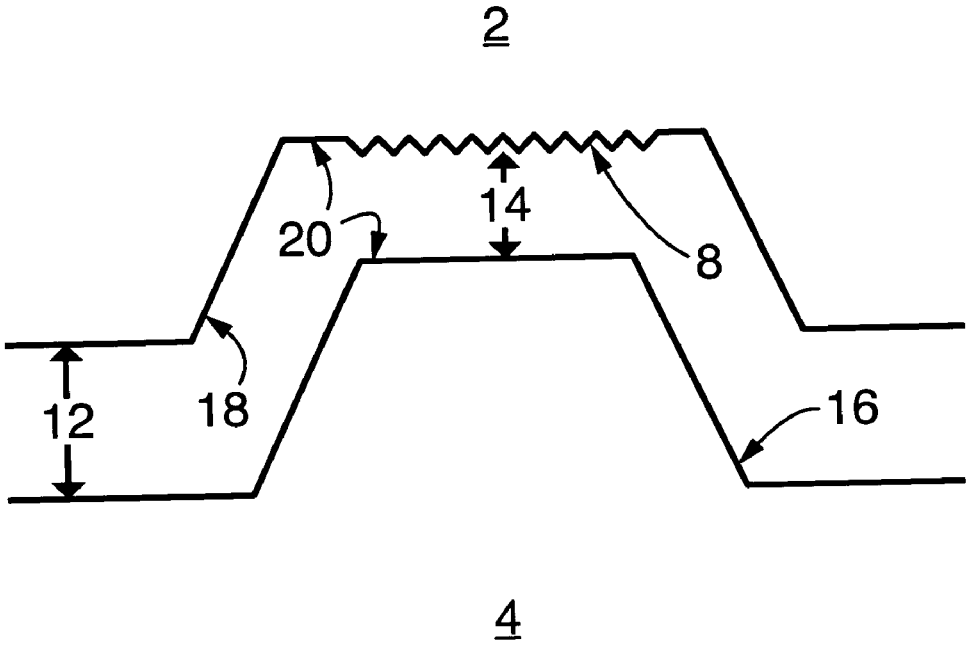
FIG. 4 is a further detailed cross section of FIG. 1, showing a third embodiment of the present invention.

A third embodiment of the present invention is shown in FIG. 4, which produces improved sheet article strip having conventional macroscopic embossed features imprinted thereon, but also having a fine scale microscopic pattern imprinted on the macroscopic feature. As seen in FIG. 4, one of the pair of rolls has a projection 16 projecting from its surface and the other of the pair of rolls has a recess 18 extending into its surface. The projection 16 and recess 18 are macroscopic in area and depth. The projection 16 and the recess 18 are shaped and dimensioned so that said projection 16 extends across the roll gap 12 into the recess 18 when the pair of rolls are rotated to bring the projection 16 and recess 18 into alignment. When aligned, the projection 16 and the recess 18 have confronting ends 20. Such rolls are well known in the art and are conventionally used to create macroscopic embossing features on rolled strip metal.

In this embodiment of the present invention a patterning feature 8 having a micron-scale topography is introduced on at least one of confronting ends 20. FIG. 4 shows the patterning feature 8 formed on the end 20 of the recess 18; however, the patterning feature 8 may alternatively be formed on the end surface 20 of the projection 16. The confronting ends 20 are separated by the space 14 that is narrower than the roll gap 12. The space 14 is established by making either the recess 18 shallower than the projection 16, or by making the projection 16 deeper than the recess 18. The space 14 creates local pressure intensification at the embossed feature, to allow the transfer of the micron-scale topography of the patterning feature 8 across parts or all of the embossed feature. The result is a macroscopic embossed feature having a micron-scale pattern topography imprinted thereon. In regions other than the confronting ends 20, the spacing between the projection 16 and recess 18 is preferably the same as the roll gap 12.

Figure 5:
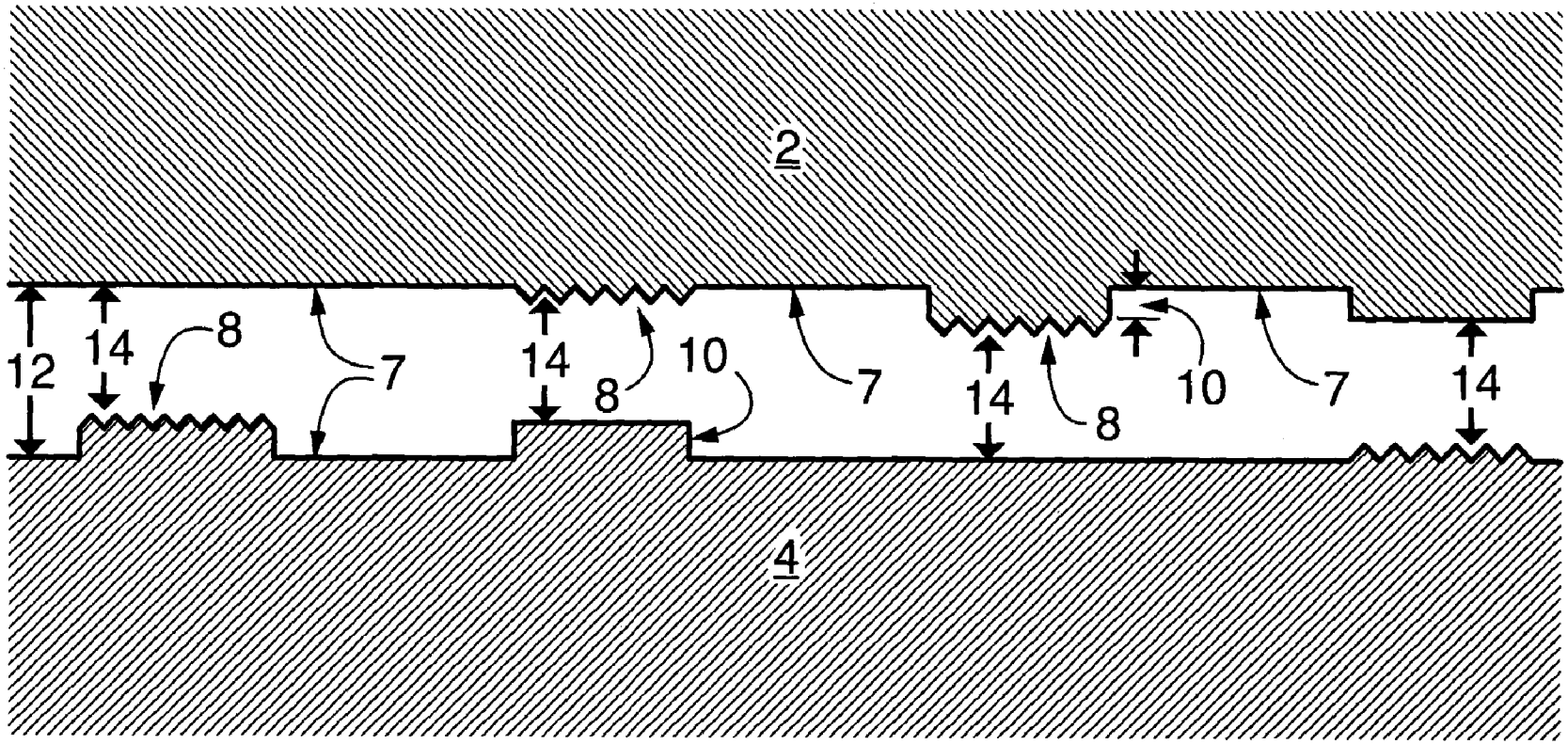
FIG. 5 is a further detailed cross section of FIG. 1, showing a fourth embodiment of the present invention.

In a fourth embodiment as shown in FIG. 5, similar or different patterning features 8 can be applied to the work roll 2 and the counter roll 4, whereby one or both of the rolls have plateau features 10, to align with each of the patterning features 8, thereby allowing for similar or different patterns to be applied to both surfaces of the sheet article 6.

In all of the embodiments described above, the thickness and mechanical properties of the sheet article substrate, as well as the nature of pattern to be imprinted will determine how much narrower the space 14 should be than the roll gap 12. As well, the concentration of localized patterns on the roll surface (percentage of the area of the sheet article to be imprinted) will depend upon such factors as the gauge and temper of the metal to be imprinted, the original topography of the sheet metal and the nature of pattern to be imprinted.

In all of the embodiments described above, the roll gap 12, corresponding to regions 7 having no patterning features 8, is sufficiently narrow to engage the strip metal article and prevent buckling or wrinkling of the strip article in the roll bite, but is wide enough to maintain a rolling pressure on the strip metal article that is lower than the bulk elastic yield strength of the metal.

Many well known methods in the art of patterning or engraving the rolls can be applied to the present invention to form patterning feature 8 and plateau feature 10. These methods include rotogravure printing systems in which cylindrical rolls are engraved to give the desired surface patterning. As well, photoresist, optical masking and etching methods can also be used and are particularly effective for very fine scale patterning in the range of 1000 lines per millimeter (25400 lines per inch).

This detailed description of the apparatus and processes of the present invention is used to illustrate the prime embodiments of the present invention. It will be apparent to those skilled in the art that various modifications can be made in the present apparatus and processes and that various alternative embodiments can be utilized. Therefore, it will be recognized that modifications can be made in the present invention without departing from the scope of the invention, which is limited only by the appended claims.

The invention claimed is:

1. A cold rolling apparatus for impressing a pattern on a surface of a sheet article made of a predetermined metal, said apparatus comprising:

a. a pair of rolls each having an outer surface that has a cylindrical part, said rolls being disposed with a gap present between said cylindrical parts of said rolls;

b. one of the rolls of said pair having a localized surface region that is displaced by at least 5 microns relative to the cylindrical part of said roll such that, when said localized region is brought into proximity with the other roll of said pair, a spacing exists therebetween that is narrower than said gap; and c. one of said rolls of said pair having a localized patterning feature to be impressed on the surface of said sheet article, said localized patterning feature being aligned with said localized surface region, at least when engaging said sheet article, for impressing said pattern into the surface of said sheet article;

wherein the gap is of a width effective to cause the cylindrical parts of said rolls to engage opposite surfaces of the sheet article while imparting compression less than a bulk elastic yield strength of said metal.

2. The apparatus of claim 1 wherein the localized surface region is formed by a method selected from the group consisting of selective back polishing, grinding, rotogravure printing, photoresist, optical masking and etching.

3. The apparatus of claim 1, wherein said localized surface region and said patterning feature are both present on one of said pair of rolls, with said patterning feature forming at least part of an outer surface or outline of said localized region.

4. The apparatus of claim 1, wherein said localized surface region is formed on one of said pair of rolls and said patterning feature is formed on the other of said pair of rolls.

5. A cold rolling apparatus for impressing a pattern on a surface of a sheet article made of a predetermined metal, said apparatus comprising:

a. a pair of rolls each having an outer surface that has a cylindrical part, said rolls being disposed with a gap present between said cylindrical parts of said rolls having a width effective to cause the cylindrical parts of said rolls to engage opposite surfaces of the sheet article while imparting compression less than a bulk elastic yield strength of said metal;

b. one of the rolls of said pair having a localized surface region that is displaced relative to the cylindrical part of said roll such that, when said localized region is brought into proximity with the other roll of said pair, a spacing exists therebetween that is narrower than said gap; and c. one of said rolls of said pair having a localized patterning feature to be impressed on the surface of said sheet article, said localized patterning feature being aligned with said localized surface region, at least when engaging said sheet article, for impressing said pattern into the surface of said sheet article;

wherein one of said pair of rolls has a projection from its cylindrical part and the other of said pair of rolls has a recess in its cylindrical surface, said projection and said recess being shaped and dimensioned so that said projection extends across said gap into said recess when said rolls are rotated to bring said projection and recess into alignment, in which orientation said projection and recess having confronting ends that are separated by said spacing that is narrower than said gap, with said patterning feature being present on at least one of said confronting ends.

6. The apparatus of claim 5 wherein the projection and the recess are macroscopic in depth and wherein the confronting ends are macroscopic in area.

* * * * *